United States Patent [19]

Lingaraju

[11] 4,172,628

[45] Oct. 30, 1979

[54] PRESSURE LOCK RECEPTACLE TERMINAL

[75] Inventor: Bhartoor Lingaraju, Allentown, Pa.

[73] Assignee: Square D Company, Park Ridge, Ill.

[21] Appl. No.: 867,541

[22] Filed: Jan. 6, 1978

Related U.S. Application Data

[63] Continuation-in-part of Ser. No. 720,281, Sep. 3, 1976, abandoned.

[51] Int. Cl.[2] ..... H01R 9/12

[52] U.S. Cl. ..... 339/95 D

[58] Field of Search ..... 339/95 D

[56] References Cited

U.S. PATENT DOCUMENTS

| | | | |
|---|---|---|---|
| 3,489,985 | 1/1970 | Martin | 339/95 D |
| 3,543,221 | 11/1970 | Schmier | 339/95 D |

FOREIGN PATENT DOCUMENTS

| | | | |
|---|---|---|---|
| 1447935 | 9/1976 | United Kingdom | 339/95 D |

*Primary Examiner*—Joseph H. McGlynn

*Attorney, Agent, or Firm*—Carmen B. Patti; Richard T. Guttman

[57] ABSTRACT

A push-in type pressure lock terminal for electrical receptacles wherein the bared end of various diameter sized conductors may be inserted into a recess in the receptacle for connection with the internal conductive element thereof, and which is then held therein by a restraint element against withdrawal until the restraint is released. The restraint element comprises a double-action cantilever spring integrally formed from the internal conductive bus element of the receptacle. The double-action spring deflects over a relatively wide range within a limited space within the receptacle to thereby accommodate a range of various diameter sized conductors without causing an objectionable permanent set to occur in the spring. The cantilever spring produces a double-action deflection in the direction of insertion when a wire conductor is inserted and bears against such free end. The wire conductor is inserted until the free end of the spring deflects enough to allow a portion of the wire conductor to extend past the deflected free end. The free end of the spring then bears against a first side of the wire conductor at an obtuse angle facing the direction of insertion and at an acute angle facing the direction of withdrawal until the biasing force of the cantilever spring against the wire conductor is released. The cover portion of the receptacle includes a depending wire guide portion which includes an arcuate bearing wall against which the second opposite side of the wire conductor bears when the cantilever spring is biased against the first side of the wire. The depending wire guide portion of the cover also includes a recess having a continuous bounding wall in which the end of the wire seats to prevent skewing and for positive alignment with the cantilever spring.

5 Claims, 8 Drawing Figures

PRESSURE LOCK RECEPTACLE TERMINAL

This is a continuation-in-part application of application Ser. No. 720,281 filed Sept. 3, 1976 now abandoned.

BACKGROUND OF THE INVENTION

This invention relates to the field of pressure lock terminals for electrical receptacles wherein the bared end of a wire conductor is inserted into a recess of the receptacle for electrical connection therewith, and it becomes locked therein until released.

Prior art devices of this type have used various types of cantilevered spring members formed from the conductive bus element of the receptacle to bear against one side of an inserted wire conductor, and an oppositely facing bearing wall or anvil also formed from the conductive bus element to bear against the second opposite side of the inserted wire conductor.

One problem encountered by such prior art devices was skewing of the inserted wire conductor away from the free end of the cantilever spring with resultant loss of electrical contact, creation of a high resistance connection, and weakening or complete loss of the mechanical connection whereby the wire conductor could be accidentally withdrawn entirely from the receptacle leaving a bared end of the conductor exposed.

Another problem encountered by prior art devices is the inability to receive various sized diameter conductors through a plug-in aperture in the back of the receptacle without causing a permanent set to occur in the spring when a relatively large conductor is inserted through the aperture. A permanent set occurs in the spring when a conductor having a large diameter is inserted and the size of the diameter of the conductor causes the spring to deflect beyond its elastic limits thus resulting in a spring which does not return to its original position after the conductor is withdrawn. Existing prior art devices have a single action cantilever spring, and in order to adapt such springs for a wide range of various diameters of conductors, a relatively large lever arm to obtain the magnitude of deflection is needed to accommodate a wide range of conductor diameters without causing a undesirable permanent set to occur.

The present invention solves the problem of skewing by providing a recess having a continuous bounding wall in which the inserted bared end of the wire conductor seats. The wire conductor is thus positively held against skewing and is retained in alignment with the free end of the cantilever spring which biases the wire conductor against an oppositely facing anvil or bearing wall which extends longitudinally from the recess having a completely bounding wall to the opening to the exterior surface of the receptacle. The anvil or bearing wall is provided with a concave bearing face throughout its longitudinal extent, to bear against and support a substantial portion of the circumference of the bared wire conductor throughout its full inserted length. Thus, in addition to the fully bounded wall of the seat which positively retains the end of the inserted wire conductor from skewing, the concave surface of the anvil or bounding wall provides a trough which also retains the inserted wire conductor from skewing. To accomplish these objectives the fully bounded seat and the concave anvil wall are formed as depending members of the cover portion of the receptacle.

The present invention provides a receptacle which is adapted to receive various diameter size conductors by using a double action spring which enables the spring to deflect over a wide range to accommodate differing conductor diameters without resulting in an undesirable permanent set. The double action spring mechanism permits the adaptation to various conductor diameters without allocating any more space within the receptacle for the double action spring than is provided for springs in prior art devices.

SUMMARY OF THE INVENTION

It is an object of the invention to provide a pressure lock terminal for electric receptacles, wherein the bared end portion of a wire conductor inserted for connection with said terminal is held in alignment with the pressure lock element and prevented from skewing out of such alignment.

It is an object of the invention to provide a pressure lock terminal for electric receptacles, including socket means within the receptacle comprising a fully bounded recess with a continuous side wall to receive the free end of the bared wire conductor and to hold it against lateral movement.

It is an object of the invenion to provide a pressure lock terminal for electric receptacles, including a cantilever spring member integrally formed with the conductive bus element within the receptacle, the spring member having a free end facing in one direction toward an anvil wall member, said anvil wall member having a concave wall surface facing said free end of said cantilever spring member, the bared end portion of a wire conductor being receivable between said free end of the cantilever spring member and said concave anvil wall member for restraint by said concave anvil wall against lateral movement of said bared end portion of the wire conductor.

It is an object of the invention to provide a pressure lock terminal for electric receptacles, including a cantilever spring member integrally formed with the conductive bus element within the receptacle, an anvil wall positioned oppositely of said cantilever spring member to bias a wire conductor between the anvil wall and cantilever spring, said anvil wall being formed integral with the cover portion of said receptacle.

It is a further object of the invention to provide a pressure lock terminal for electrical receptacles which includes a cantilever spring capable of receiving various diameter size conductors.

DESCRIPTION OF PREFERRED EMBODIMENT

Figure 1:
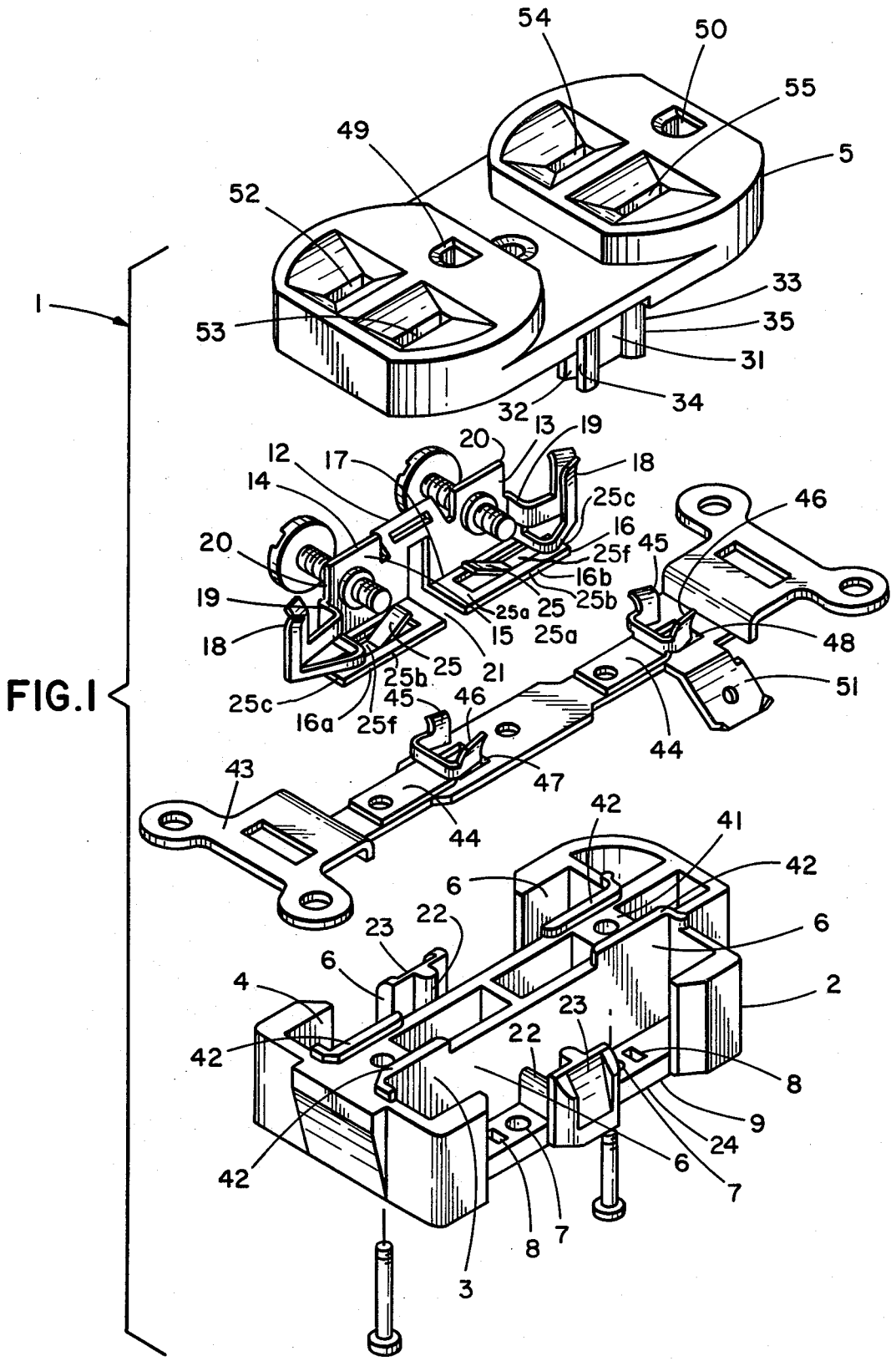
FIG. 1 is an exploded view of a receptacle having a pressure lock terminal in accordance with this invention.
Figure 2:
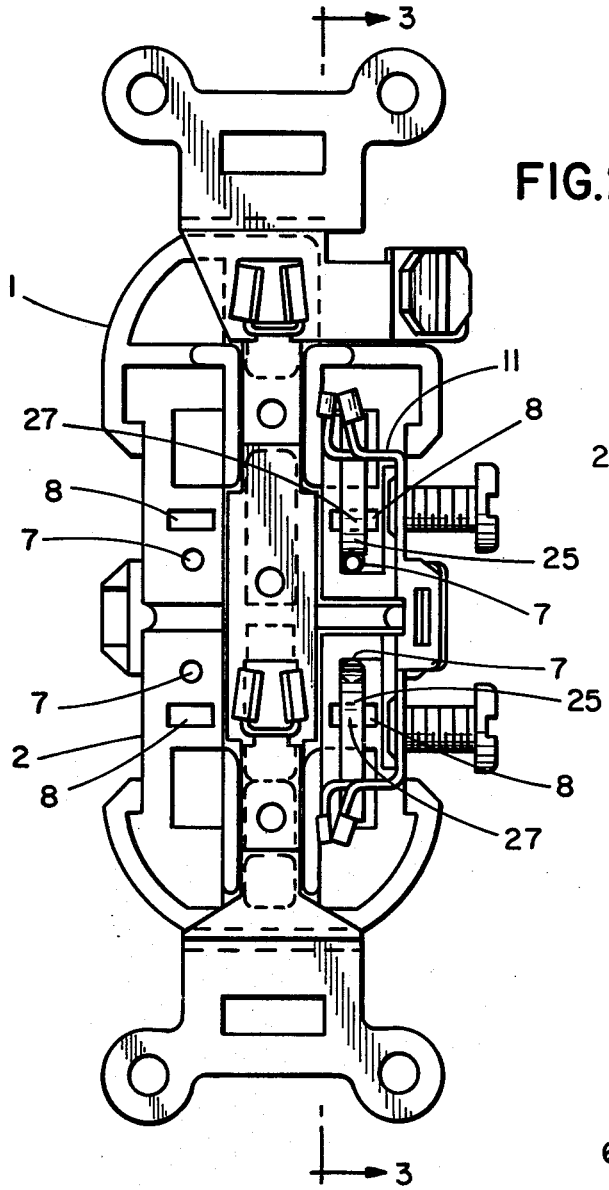
FIG. 2 is a top plan view of a receptacle having a pressure lock terminal in accordance with this invention shown with the cover removed.

A duplex receptacle 1 includes a body member 2 having two compartments 3 and 4, each of which is divided into two cavities when receptacle cover 5 is put in place thus providing four pressure lock cavities 6. The body member 2 and the receptacle cover 5 are of electrical insulation material such as phenolic plastic.

Each of said cavities 6 includes a pair of apertures 7 and 8 opening to the exterior wall 9 of receptacle body 2. Each aperture 7 is preferably circular and dimensioned to receive the bared end of a wire conductor 10 therethrough. Each aperture 8 is spaced apart from its respective adjacent aperture 7 to receive a tool end therethrough for the purpose of releasing the pressure lock terminal described hereinafter. Each aperture 8 may be of rectangular configuration.

A pair of conductive bus elements 11 and 12 seat within compartments 3 and 4 respectively of the receptacle body 2. Each of said bus elements includes an upright wall 13 having an outwardly facing surface 14 and an inwardly facing surface 15. A base 16 extends inwardly from the lower edge 17 of upright wall 13 at substantially a right angle thereto. Jaw members 18 are formed to extend outwardly from flanges 19 which project at substantially right angles from opposite side edges 20 of upright wall 13. The jaw members 18 extend from flanges 19 also at substantially right angles to thereby lie substantially parallel with upright wall 13 and spaced apart inwardly therefrom.

A median slot 21 is formed at the midpoint of wall 13 extending downwardly and across the base 16 dividing said base into segments **16*a* and 16*b*. A pair of L-shaped dividing ribs 22 are formed to project inwardly respectively from each median side wall 23 of the receptacle body 2. The median side walls 23 extend upwardly from the base 24 of receptacle body 2 at opposite sides thereof and approximately midway between each opposite end. One of said L-shaped dividing ribs 22 is received in said median slot 21 of conductive bus element 11, and the other of said L-shaped dividing ribs 22 is received in the corresponding median slot 21 of the other conductive bus element 12, when said bus elements 11 and 12 are seated respectively in compartments 3 and 4 of receptacle body 2. The L-shaped ribs 22 serve to hold said bus elements against lateral movement and to orient the pressure lock terminals described hereinafter with respect to the apertures 7 and 8 of each cavity 6**.

The pressure lock terminals in accordance with this invention include cantilever spring members 25 which are integrally formed with the base 16 of the conductive bus elements. A pair of said spring members 25 are formed in each of said conductive bus elements 11 and 11, and so located as to overlie respective pairs of apertures 7 and 8 in each cavity 6 when said bus elements 11 and 12 are seated in their respective compartments 3 and 4. The respective free end portions 26 of spring members 25 overlie the circular apertures 7 which receive the bared end of wire conductor 10, and respective mid-portions 27 of the spring members 25 overlie the rectangular apertures 8 which receive a tool end therethrough for release of the pressure lock terminal.

Figure 5:
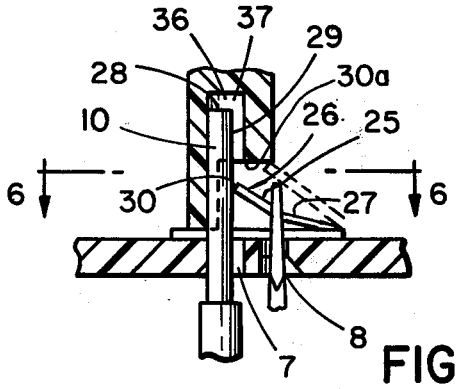
FIG. 5 is a fragmentary section view of a receptacle and cover showing the pressure lock terminal in accordance with this invention having the bared end of a conductor connected therein.

When the bared end of a wire conductor 10 is inserted through aperture 7 it engages the free end portion 26 of a spring member 25 causing it to deflect inwardly in the direction of insertion until the free end 28 of conductor 10 passes the said free end portion 26 of a spring member 26. At such time, cantilever spring member 25 biases against the adjacent side 29 of conductor 10 at an obtuse angle facing toward the direction of insertion and at an acute angle facing toward the direction of withdrawal. Such biasing force applied at such angle causes the edge 30 of free end 26 of spring member 25 to bite into the bared wire conductor 10 if an attempt is made to move the wire conductor in the direction of withdrawal to effectively lock the wire conductor in place until the biasing force is released. As shown in FIG. 5, to release such biasing force, the pointed end of a tool such as a screwdriver may be inserted through rectangular aperture 8 whereupon it engages the mid-portion 27 of spring member 25 causing it to deflect inwardly. A stop surface **30*a*, molded within the receptacle, is selectively spaced from the aperture 8 to serve as a stop means when the cantilever spring 25 is deflected by a tool to move it away from a conductor to permit the conductor to be withdrawn from the receptacle. The location of the surface 30*a* permits the spring member 25 to be moved clear of the conductor without inadvertently causing a permanent set in the spring member 25. If a permanent set occurred, the spring member 25 when not returned to its original position and conductors subsequently inserted in the aperture 7 might not make a good mechanical and electrical connection with the spring member 25 because it would be out of position to engage the conductor. The edge 30 of cantilever spring 25 is then caused to move out of engagement against wire conductor 10** thus releasing it for withdrawal from the pressure lock terminal.

The terminal is able to accommodate the varying diameter size conductors because a double action mechanism is provided in the cantilever spring. As best seen in FIG. 1, the electrically conductive contact strip such as bus element 12 includes a spring support **25*a* extending perpendicularly from the bus element 12. A first arm 25*b* extends from the spring support 25*a* parallel to the bus element 12. A lateral connecting section 25*c* extends from the first arm 25*b* toward the conductive bus element 12, and is connected to a base portion of a second arm 25*f* which extends from the section 25*c* and toward the spring support 25*a***.

Figure 3:
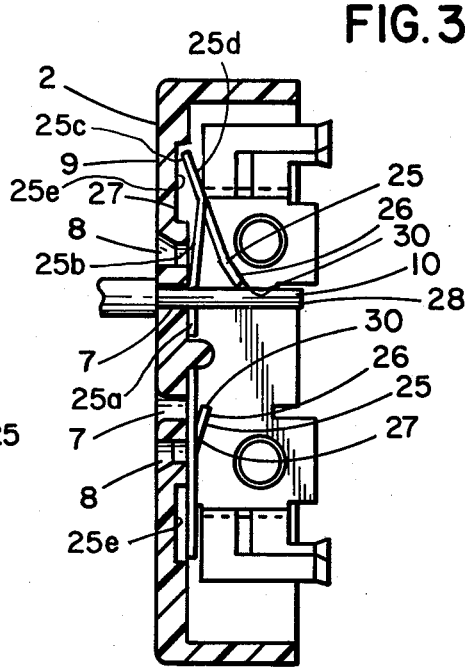
FIG. 3 is a section taken on line 3—3 of FIG. 2 including a fragment of a support element of the cover of the receptacle.
Figure 4:
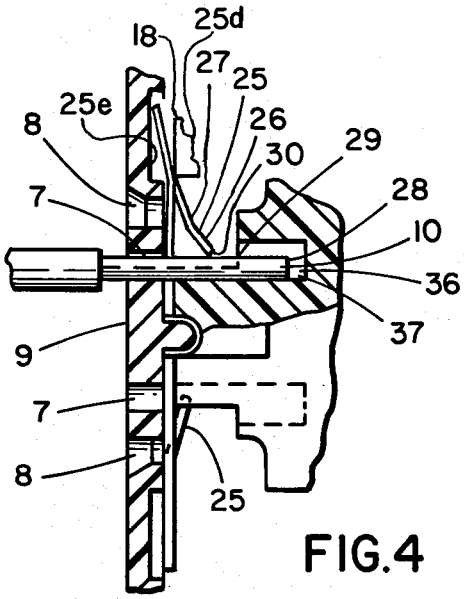
FIG. 4 is a fragment of the section taken on line 3—3 of FIG. 2 and showing a fragment of the cover in place partly in section.
Figure 6:
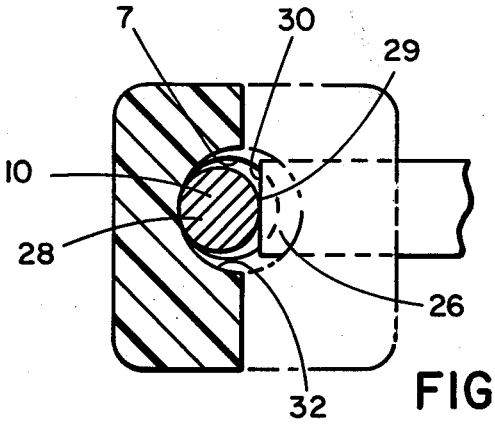
FIG. 6 is an enlarged section taken on line 6—6 of FIG. 5.
Figure 8:
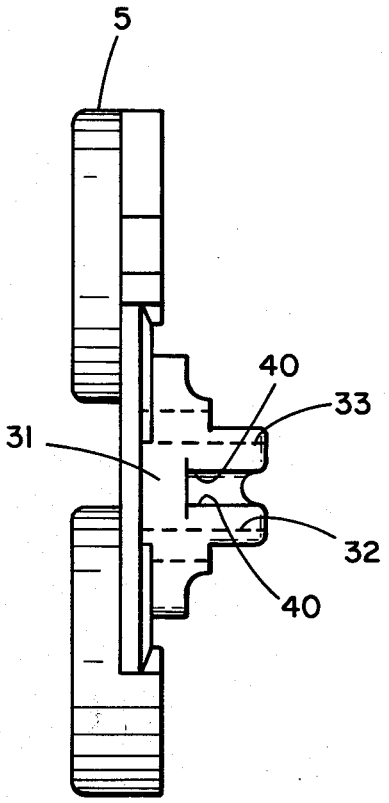
FIG. 8 is a side elevation view of the receptacle cover shown in FIG. 7.
Figure 7:
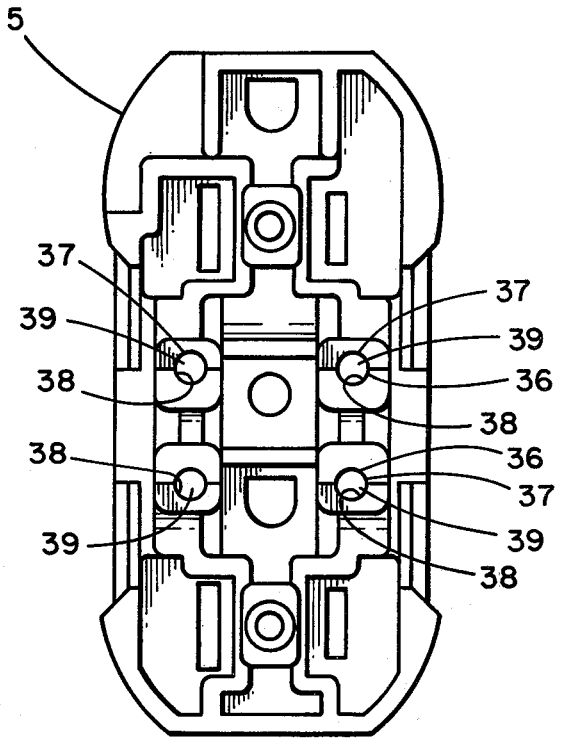
FIG. 7 is a bottom plan view of a receptacle cover showing socket and guide members which form a part of this invention.

As best shown in FIGS. 3 and 4, when a conductor is inserted in the aperture 7 it contacts the free end 30 of the cantilever spring and causes the spring 25 to deflect upward inturn causing the lateral connecting section **25*c* to also deflect upward and to contact a lower edge 25*d* of the jaw member 18, which is selectively spaced above the lateral connecting section 25*c*. As the conductor is inserted further into the aperture 7 as best seen in FIG. 3 and 4, the lateral connecting section rotates about the lower edge 25*d* with the lateral connecting section 25*c* eventually contacting the recess 25*e* which acts as a stop means. Further deflection may occur in the cantilever spring 25 depending on the diameter of the conductor inserted through the aperture 7**.

Receptacle cover 5 includes a pair of depending support elements 31 located approximately mid-way between the opposite ends of cover 5 and depending downwardly from opposite sides thereof. Each support element 31 includes a pair of longitudinally extending concave walls 32 and 33 facing outwardly in opposite direction from side edges 34 and 35 of said support elements 31. The respective positions of said oppositely facing concave walls 32 and 33 are such that when cover 5 is put in place over receptacle body 2, the concave wall 32 is substantially aligned with that portion of the wall of an aperture 7 in one of said compartments 3 or 4 which faces oppositely of the edge 30 of a corresponding spring member 25; and concave wall 33 is similarly aligned with the wall of the other of said apertures 7 in said one compartment. In this manner, when cover 5 is in place with the pair of support elements 31 depending downwardly into compartments 3 and 4 respectively, concave walls 32 and 33 of each of said support elements provide concave anvil surfaces or bearing walls aligned with the walls of each aperture 7 respectively. Thus as the bared end of wire conductor 10 is inserted through an aperture 7 it first engages the free end portion 26 of a corresponding cantilever spring member 25 causing it to deflect. The biasing force of the free end 30 of such cantilever spring member biases the inserted wire conductor against the oppositely facing concave wall 32 or 33 of a support element 31. The concave walls thus serve as concave anvil surfaces for respective cantilever spring members. The concavity of the walls 32 and 33 serves to restrain wire conductor 10 from lateral movement as it is inserted through aperture 7 against the biasing force of edge 30 of spring member 25, and after it has been fully inserted. Thus, wire conductor 10 is restrained from skewing out of alignment with the free edge 30 of spring member 25, and is instead held in proper alignment for full surface contact with said free edge 30 for improved mechanical and electrical connection.

Socket means 36 is also provided in said cover 5, comprising four recesses 37, each having a continuous circular side wall 38, providing a cylindrical cavity 39 therein dimensioned to receive an retain the free end 28 of wire conductor 10 therein when fully inserted. A portion of said cylindrical side wall 38 of each recess 37 is integrally merged with the inwardly projecting end 40 of a respective arcuate wall 32 or 33. The axis of cylindrical cavity 39 of each recess 37 is aligned with the axis of a respective one of said apertures 7 opening to exterior wall 9 of receptacle body 2 when said cover 5 is in place thereon.

The support elements 31 concave walls 32 and 33, and socket means 36 are integrally formed on receptacle cover 5 and are of the same electrically insulated material such as phenolic.

When the bared end of wire conductor 10 is inserted through an aperture 7, first engaging and deflecting a corresponding cantilever spring member 25, then being forced against a corresponding arcuate wall 32 or 33, as said conductor 10 continues to be inserted its free end 28 eventually enters cylindrical cavity 39 of a corresponding one of said recesses 38 and becomes seated therein. In this manner and in accordance with this invention, the conductor 10 is held in alignment with said free edge 30 of the corresponding cantilever spring 25, enabling it to bias with full force against the adjacent side 29 of conductor 10, for improved mechanical and electrical connection.

The receptacle body 2 includes a centrally disposed longitudinal pedestal 41, having side rails 42 projecting upwardly from opposite sides of said pedestal 41. A mounting yoke 43 is provided to seat on said pedestal 41 between side rails 42. The yoke 43 includes ground connection elements 44 having resilient arcuate ends 45 and 46 positioned adjacent respective apertures 47 and 48 and partially overlying such apertues. When cover 5 is placed over receptacle body 2 with yoke 43 thereon, the ground prong apertures 49 and 50 of cover 5 are in registration respectively with apertures 47 amd 48 of said yoke. The arcuate ends 45 and 46 of ground connection elements 44 project partially into the respective passageways between ground prong aperture 49 and its corresponding yoke aperture 47; and between ground prong aperture 50 and its corresponding yoke aperture 48. When the ground prong of a plug is inserted through apertures 49 or 50 in cover 5, it engages the arcuate ends 45 and 46 of the ground connection element to establish a ground connection. The yoke 43 includes ground screw terminal base 51, to which a grounding conductor may be connected. The cover 5 includes two additional pairs of apertures 52–53 and 54–55. The pair of apertures 52–53 are in registration with one pair of jaw members 18 comprising one jaw member of conductive bus element 11 at one end thereof and one jaw member of conductive bus element 12 at the corresponding end thereof. The other pair of apertures 54–55 are in registration with the pair of jaw members formed by the respective jaw members 18 at the respective opposite ends of conductive bus elements 11 and 12. One of said bus elements 11 or 12 may be connected to the neutral conductor and the other to the line or electrified conductor. Such connections are made in the manner described above by inserting the bared end of the neutral conductor in an aperture 7 to engage the cantilever spring 25 of one bus element such as 11, and by inserting the line conductor in an aperture 7 to engage the cantilever spring 25 of the other bus element 12.

I claim:

1. An electrically conductive double-action pressure lock terminal assembly for an electrical wiring device capable of holding various diameter sized condutors, said pressure lock terminal assembly comprising:

an electrically conductive contact strip having at least one releasable conductor clamping spring providing a secure mechanical and electrical connection with a bared end of said conductor, said spring having, a spring support connected to said electrically conductive contact strip, a first arm attached to said spring support and extending at right angles from said spring support parallel to said electrically conductive contact strip, a lateral connecting section extending from and substantially perpendicular to said first arm and extending toward said electrically conductive contact strip, a second arm extending from said lateral connection section and extending toward said spring support between said first arm and said electrically conductive contact strip, a first stop means attached to said electrically conductive contact strip and extending from said strip a selected distance above said lateral connecting section for restricting upward movement of said lateral connecting section, a non-electrically conductive base for holding said electrically conductive contact strip, a second stop means associated with said non-electrically conductive base and located a selected distance below said lateral connecting section for restricting downward movement of said lateral connecting section, whereby, when said conductor is inserted in said pressure lock terminal assembly, said conductor contacts a free end of said second arm opposite said lateral connecting section and causes said second arm of said spring to deflect upward in turn causing said first arm and said lateral connecting section to also deflect upward and to eventually contact said first stop, thereafter, as said conductor is inserted further into said pressure lock terminal assembly, said lateral connecting section rotates about said first stop and eventually contacts said second stop associated with said non-electrically conductive base thereby resulting in second arm deflecting to a greater extent than said first arm, said deflection of said first and second arms resulting in a first action and said deflection of said second arm after said later connecting section contacts said second stop resulting in a second action thereby providing a double action effect.

2. The device defined in claim 1 wherein said first stop is one of a set of contact spring elements attached to said electrically conductive contact strip and said second stop is a recess in said non-electrically conductive base.

3. The device defined in claim 1 wherein said non-electrically conductive base also includes a circular aperture located beneath said first end of said second arm whereby said circular aperture enables various conductor sizes to be utilized with said pressure lock terminal assembly such that the conductor will be aligned properly with said conductor clamping spring on said electrically conductive contact strip.

4. The device defined in claim 3 wherein said non-electrically conductive base also comprises an anvil having an arcuate wall in a facing relationship with said second arm and axially aligned with said circular aperture for receiving thereagainst a first side of the bared end of a conductor inserted through said aperture, an opposite side of said bared end of the conductor engaged by the free of the second arm.

5. The device defined in claim 4 wherein said non-electrically conductive base also comprises a socket integrally formed with said anvil having a recess defined by a continuous circular side wall and axially aligned with said arcuate wall, the recess in a facing relationship with said circular aperture for receiving an end of said conductor.

* * * * *

UNITED STATES PATENT AND TRADEMARK OFFICE

CERTIFICATE OF CORRECTION

PATENT NO. : 4,172,628

DATED : October 30, 1979

INVENTOR(S) : Bhartoor Lingaraju

It is certified that error appears in the above-identified patent and that said Letters Patent are hereby corrected as shown below:

| Column | Line | |
|---|---|---|
| 3 | 62 | Change "11" second occurence to --12-- |
| 4 | 8 | Change "26" second occurence to --25-- |
| 6 | 5 | Change "apertues" to --apertures-- |
| 6 | 40 | Change "condutors" to --conductors-- |

Signed and Sealed this

*Twenty-ninth* Day of *July 1980*

[SEAL]

*Attest:*

SIDNEY A. DIAMOND

*Attesting Officer*

*Commissioner of Patents and Trademarks*